US005600354A

United States Patent [19]

Hackleman et al.

[11] Patent Number: 5,600,354

[45] Date of Patent: Feb. 4, 1997

[54] WRAP-AROUND FLEX WITH ADDRESS AND DATA BUS

[75] Inventors: David E. Hackleman, Monmouth; William A. Buskirk, Albany, both of Oreg.; Ross R. Allen, Belmont, Calif.

[73] Assignee: Hewlett-Packard Company, Palo Alto, Calif.

[21] Appl. No.: 228,471

[22] Filed: Apr. 14, 1994

Related U.S. Application Data

[63] Continuation-in-part of Ser. No. 864,890, Apr. 2, 1992, Pat. No. 5,469,199.

[51] Int. Cl.[6] ..... B41J 2/01

[52] U.S. Cl. ..... 347/50

[58] Field of Search ..... 347/12, 13, 19, 347/42, 50, 57, 58, 59, 180, 181, 182

[56] References Cited

U.S. PATENT DOCUMENTS

| | | | |
|---|---|---|---|
| 4,528,577 | 7/1985 | Cloutier et al. | 346/140 R |
| 4,578,687 | 3/1986 | Cloutier et al. | 346/140 R |
| 4,812,859 | 3/1989 | Chan et al. | 346/140 R |
| 4,887,098 | 12/1989 | Hawkins et al. | 347/58 |
| 4,899,180 | 2/1990 | Elhatem et al. | 347/59 |
| 4,967,203 | 10/1990 | Doan et al. | 346/1.1 |
| 4,982,199 | 1/1991 | Dunn | 346/1.1 |
| 5,160,945 | 11/1992 | Drake | 347/42 |
| 5,477,243 | 12/1995 | Tamura | 347/12 |

FOREIGN PATENT DOCUMENTS

| | | | |
|---|---|---|---|
| 0034060 | 2/1981 | European Pat. Off. | B41J 3/04 |
| 0388073 | 3/1990 | European Pat. Off. | B41J 2/05 |
| 0415718 | 8/1990 | European Pat. Off. | B41J 2/345 |
| 0441635A1 | 8/1991 | European Pat. Off. | B41J 2/05 |
| 0512799 | 5/1992 | European Pat. Off. | B41J 2/155 |
| 0564102 | 3/1993 | European Pat. Off. | B41J 2/16 |
| 0592221 | 10/1993 | European Pat. Off. | G06K 15/10 |
| 1004357 | 9/1989 | Japan | B41J 3/10 |
| 4298355 | 10/1992 | Japan | B41J 2/32 |

*Primary Examiner*—Benjamin R. Fuller
*Assistant Examiner*—L. Anderson

[57] ABSTRACT

A plurality of inkjet printhead elements are arranged to form a pagewide printhead array. The elements are secured to a flexible interconnect to allow for communication between the individual elements and a printer controller. The elements are arranged in the array so that one or more nozzles overlap nozzles of the two adjacent elements. The printer controller specifies the desired drivers of the heater elements to be actuated in commands sent to the first element in the array over the flexible interconnect. The printer elements monitor the interconnect to determine whether the command specifies a heater element under their control. The printer elements then actuate the specified heater element to cause an ink droplet to be ejected from a nozzle corresponding to the selected heater element.

33 Claims, 4 Drawing Sheets

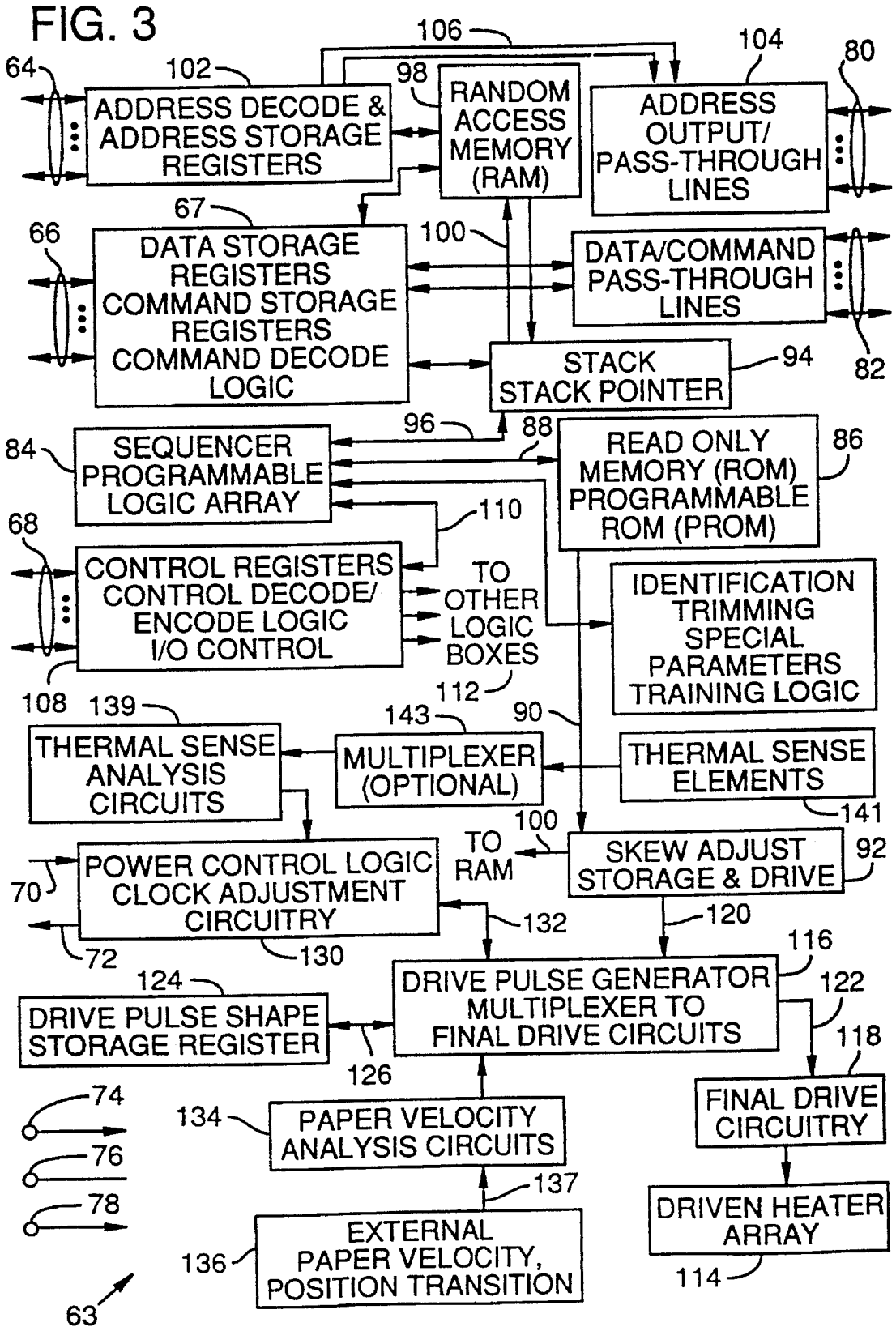
FIG. 3
106
104
80
64
102
98
ADDRESS DECODE & ADDRESS STORAGE REGISTERS
RANDOM ACCESS MEMORY (RAM)
ADDRESS OUTPUT/ PASS-THROUGH LINES
67
66
100
DATA STORAGE REGISTERS COMMAND STORAGE REGISTERS COMMAND DECODE LOGIC
DATA/COMMAND PASS-THROUGH LINES
STACK STACK POINTER
94
82
96
88
84
SEQUENCER PROGRAMMABLE LOGIC ARRAY
READ ONLY MEMORY (ROM) PROGRAMMABLE ROM (PROM)
86
110
68
CONTROL REGISTERS CONTROL DECODE/ ENCODE LOGIC I/O CONTROL
TO OTHER LOGIC BOXES
IDENTIFICATION TRIMMING SPECIAL PARAMETERS TRAINING LOGIC
108
139
112
143
90
THERMAL SENSE ANALYSIS CIRCUITS
MULTIPLEXER (OPTIONAL)
THERMAL SENSE ELEMENTS
141
100
TO RAM
SKEW ADJUST STORAGE & DRIVE
92
70
POWER CONTROL LOGIC CLOCK ADJUSTMENT CIRCUITRY
132
120
72
130
116
124
DRIVE PULSE GENERATOR MULTIPLEXER TO FINAL DRIVE CIRCUITS
122
DRIVE PULSE SHAPE STORAGE REGISTER
118
126
74
134
PAPER VELOCITY ANALYSIS CIRCUITS
FINAL DRIVE CIRCUITRY
76
137
78
DRIVEN HEATER ARRAY
136
EXTERNAL PAPER VELOCITY, POSITION TRANSITION
114
63

WRAP-AROUND FLEX WITH ADDRESS AND DATA BUS

This application is a continuation-in-part of commonly assigned, application U.S. Ser. No. 07/864,890 filed Apr. 2, 1992, U.S. Pat. No. 5,469,199, entitled Wide Inkjet Printhead, incorporated herein by reference.

BACKGROUND OF THE INVENTION

1. Field of the Invention

The present invention pertains generally to inkjet printers and the like and more particularly to printhead data and control circuitry for wide-array printers.

2. Description of the Related Art

Thermal inkjet print cartridges operate by rapidly heating a small volume of ink to cause the ink to vaporize and be ejected through one of a plurality of orifices so as to print a dot of ink on a recording medium, such as a sheet of paper. Typically, the orifices are arranged in one or more linear arrays in a nozzle member. The properly sequenced ejection of ink from each orifice causes characters or other images to be printed upon the recording medium as the printhead is moved relative to the medium. The medium is typically shifted each time the printhead has moved across the medium. The thermal inkjet printer is fast and quiet, as only the ink strikes the recording medium. These printers produce high quality printing and can be made both compact and affordable.

In one prior art design, the inkjet printhead generally includes: (1) ink channels to supply ink from an ink reservoir to each vaporization chamber proximate to an orifice; (2) a metal nozzle member in which the orifices are formed in the required pattern; and (3) a silicon substrate containing a series of thin film resistors, one resistor per vaporization chamber.

To print a single dot of ink, an electrical current from an external power supply is passed through a selected thin film resistor. The resistor is then heated, in turn superheating a thin layer of the adjacent ink within a-vaporization chamber, causing a droplet of ink to be ejected through an associated orifice onto the recording medium.

One prior art print cartridge is disclosed in U.S. Pat. No. 4,500,895 to Buck et al., entitled "Disposable Inkjet Head, " issued Feb. 19, 1985 and assigned to the present assignee.

In a thermal inkjet printhead incorporating these types of discrete printheads, the thin film heaters are selectively energized while a mechanism transports the printhead across a recording medium, typically a sheet of paper. The recording medium is incrementally moved perpendicular to the travel path of the printhead so as to enable printing at virtually any location on the recording medium.

In order to selectively energize the individual thin film heaters, a printhead element is associated with each heater. The printhead element typically consists of a diode or a transistor that can be selectively enabled. Typically, a select line is associated with each printhead element which enables the printhead element when a select signal is received on the select line. In order to minimize the number of select lines, the printhead elements can be arranged in a matrix configuration. In the matrix configuration, the select lines are commonly connected to a plurality of printhead elements, each element having a separate supply line. Thus, a printhead element is selectively enabled by generating a select signal on the appropriate select line and enabling a supply signal on the appropriate supply line. After the printhead element is enabled, a current is produced therein which is passed through the corresponding thin film heater. A typical example of a matrix-type inkjet printer driver is shown in European Patent Application No. 441,635 by Matsumoto et al.

To increase the speed of printing per line on a medium and to reduce the mechanical complexity of a printer, it is known to mount separate printheads side by side to form a fixed array of printheads extending across an entire width of a medium. Selected printing elements across the array of discrete printheads are energized simultaneously to print an entire line of dots onto the medium. After the line is printed, the medium is incrementally shifted perpendicular to the array of printheads, and the printing process is repeated.

Drawbacks to this construction of an array of discrete printheads include increased electrical complexity, difficulty in precisely aligning the printheads with one another, and increasing cost in the providing the plurality of printheads.

As is apparent, with resolutions of inkjet printers becoming greater than 300 dots per inch ("dpi"), alignment of the orifices between discrete inkjet printheads across an array of eight inches or more requires extremely precise positioning to achieve satisfactory spacing between printed dots on a medium. This alignment must be maintained throughout the useful life of the product and under different conditions of duty cycle, temperature, shock, and vibration.

Furthermore, as the resolution increases, the amount of data required to selectively energize the individual thin film heaters grows geometrically. For example, a 300 dpi by 300 dpi printer produces 9000 dots per square inch. In contrast, a 600 dpi by 600 dpi printer produces 36,000 dots per square inch. Thus, doubling the horizontal and vertical resolution quadruples the dot density. In order to selectively energize the corresponding thin film heaters, the rate of the data needed to select the desired thin film heaters must increase in geometric proportion to the increase in the dot density.

In addition, as the resolution increases so does the number of thin film heaters. The size of the integrated driver circuits increases correspondingly. The yield of the silicon devices, however, is inversely proportional to the size of the die. Therefore, as the size of the printhead elements to accommodate the increased number of thin film heaters, the yield of the silicon dies reduces.

Thus, what is needed is a driver design that is flexible in order to accommodate the optimal number of thin film heaters to maximize the yield. Also, what is needed is an improved wide printhead structure which requires a reduced data rate and where precise alignment of the orifices across the printhead may be accomplished simply and precisely maintained over the life or the product and over a wide range of operating conditions.

SUMMARY OF THE INVENTION

It is, therefore, an object of the invention to reduce the data bandwidth requirements of a high-resolution pagewide inkjet printhead interconnect circuitry.

Another object of the invention is to arrange a common printhead element in an array suitable to form a pagewide inkjet printhead.

A further object of the invention is to interconnect the printhead elements in a pagewide array.

A page wide ink jet printhead element is disclosed along with a method of interconnecting a plurality of the elements on a flexible interconnect to form a pagewide inkjet printhead array. The inkjet printhead element comprises a heater array including a plurality of heater elements, each element in communication with an individual ink-jet nozzle. An actuating means is coupled to the heater array for actuating the heater array. The actuating means has a clock input and a fire strobe input for receiving a fire strobe pulse to synchronize the generation of an actuation pulse. The printhead element also includes an address pass-through network or circuitry including an address bus for sending and receiving addresses to and from a previous or upstream element and an address pass-through bus for selectively sending addresses to a subsequent or downstream element. Also, a data pass-through network is included for sending and receiving data to and from the previous and subsequent elements. In addition, the printhead element includes a means for controlling the printhead element coupled to the address pass-through network, the data pass-through network and the actuating means having control input lines for receiving control signals.

A plurality of the printhead elements described above can be arranged on a flexible interconnect circuit having a plurality of interconnect lines connected between the elements. The interconnect lines are used to transmit command and data information to and from the elements in order for the printer controller to specify the desired inkjet nozzles to be actuated. The elements are preferably arranged so that adjacent elements have overlapping nozzles to accommodate thermal expansion in the printhead. The overlapping nozzles can then be selectively enabled to produce the optimal print quality.

An advantage of the invention is that the printhead array hereinafter described can be calibrated to account for variations due to manufacturing or thermal expansion.

The foregoing and other objects, features and advantages of the invention will become more readily apparent from the following detailed description of a preferred embodiment which proceeds with reference to the drawings.

BRIEF DESCRIPTION OF THE DRAWINGS

FIG. 3 is a functional block diagram of electrical control circuitry for the printer of FIG. 1.

DETAILED DESCRIPTION OF THE PREFERRED EMBODIMENT

Figure 1:
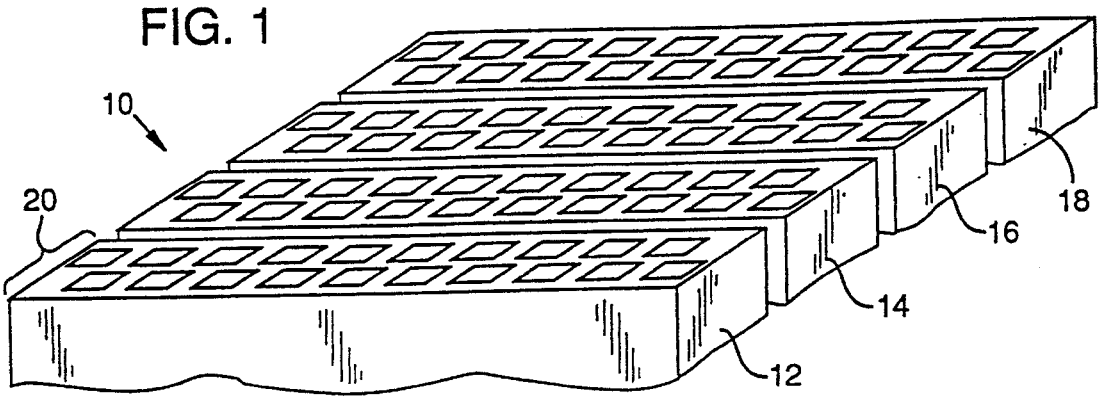
FIG. 1 is a perspective diagram of a 4-color, page-wide printhead according to the invention.

FIG. 1 shows a pagewide printhead 10, which includes four separate page-wide printer arrays (12, 14, 16, 18) each dedicated to a separate primary color, e.g., C, Y, M or K. Each of the individual page-wide arrays is designed to span the entire width of a print medium. This arrangement allows the individual page-wide arrays to be fixedly mounted to an ink jet printer frame while the print media is advanced over the top of the individual arrays. The individual arrays are mounted on separate manifolds each of which are in contact with a separate ink reservoir. Each ink reservoir supplies the individual printhead elements (20) of the corresponding array with a constant supply of the appropriate color ink. The mechanical features summarized above are described and shown in detail in U.S. Ser. No. 07/864,890 Filed Apr. 2, 1992, U.S. Pat. No. 5,469,199, incorporated by reference, and so need not be repeated herein.

Figure 2:
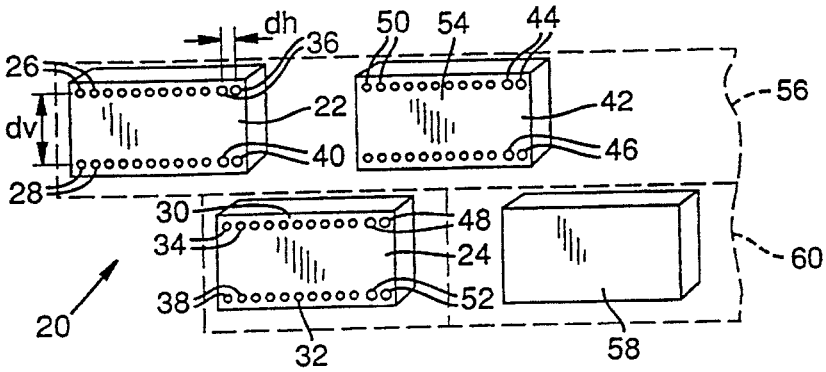
FIG. 2 is a plan view of a portion of one of the printer arrays of FIG. 1.

FIG. 2 shows a portion of array 20 comprising four individual printhead elements 22, 24, 42, 58, as mounted according to FIG. 1. A first printhead element 22 is shown having two rows of nozzles: a top row 26 and a bottom row 28. The top and bottom rows of nozzles 26, 28 each contain four additional nozzles to accommodate an overlapping nozzle pattern, as described below. Individual nozzles of the top and bottom rows 26, 28 are designed to be in contact with the ink supplied by the manifold. Within each of the individual nozzles is a transducer element (not shown) that dissipates energy when a voltage is applied thereto. This dissipation of energy causes the ink to be ejected from the nozzle. The design of the nozzles to eject ink in the aforementioned manner is known in the art to which it pertains and the preferred arrangement is disclosed in U.S. Ser. No. 07/864,890, Filed Apr. 2, 1992, U.S. Pat. No. 5,469,199

In page-wide printers, the horizontal resolution of the printer is determined in large part by the displacement between adjacent nozzles in the same row, i.e., dh. In printheads having only a single row of nozzles, the horizontal displacement is in fact the horizontal resolution of the printer. By having multiple rows, however, the individual rows can be offset from each other so as to create a higher horizontal resolution. In FIG. 2, row 28 is offset from row 26 by precisely one-half dh. This arrangement effectively doubles the horizontal resolution of the printer.

The vertical resolution of the printer is determined both by the vertical displacement dv between adjacent rows as well as the vertical step of the print media over the printhead. By providing multiple rows of nozzles on an individual printhead element the effective vertical resolution can be increased without decreasing the vertical step of the print media. This structure has the effect of decreasing printing time due to the reduced number of steps.

A second printhead element 24 is shown mounted parallel to, and offset from, the first element 22. The spatial relationship between the first printhead element 22 and the second printhead element 24 is replicated across the entire printhead array, such as shown in FIG. 1, to form a first row 56 and a second row 60 of elements. The second printhead element 24 has a top row of nozzles 30 and a bottom row nozzle 32, identical to the first element 22. This allows a single printhead element to be designed and replicated for the entire array. By using a common printhead element, the printhead element can be designed to accommodate the optimal number of heater elements so as to maximize the yield of the elements. The second printhead element 24 is offset from the first printhead element 22 such that two leftmost distal nozzles 34 are opposed to two rightmost distal nozzles 36 of the top row of the first element 22. As a consequence of overlapping said nozzles, the two leftmost distal nozzles 38 of the bottom row of the second element 24 are opposed to two rightmost distal nozzles 40 of the bottom row of the first element 22.

A third printhead element 42 is mounted collinear to first printhead element 22 to form a first row of printhead elements 56. The third printhead element 42 is similarly mounted offset from the second printhead element 24 in a manner similar to the first element 22 except the mirror image. In this case, however, two rightmost distal nozzles 48 are opposed to two leftmost distal nozzles 50 of a top row of nozzles 44 of the third printhead element 42. Once again, as a result of the two rightmost distal nozzles 48 with the two leftmost distal nozzles 50, two rightmost distal nozzles 52 of the bottom row of nozzles 32 of the second element 24 are opposed to two leftmost distal nozzles 54 of a second row of nozzles 46 of the third printhead element 42.

A fourth printhead element 58 is mounted collinear to the second printhead element 24 to form the second row of printhead element 60. The fourth printhead element is offset from the third printhead element 42 in a similar manner as the second printhead element 24 is offset from the first printhead element 22 except the mirror image.

This relationship between adjacent elements, i.e., having overlapping nozzles, is maintained across the entire printhead. Therefore, each printhead element has eight nozzles which overlap with two adjacent printhead elements of the opposite row. Alternatively, the actual number of overlapping nozzles can be modified to accommodate the anticipated amount of thermal expansion or the anticipated placement tolerance of the elements. Such an overlap allows for a simple alignment process from head-to-head in the axis of the printer, and adds 8 nozzles per head. The purpose of overlapping the nozzles will become more clear in the description of the individual elements that follows.

FIG. 3 shows a control circuit 63 of an individual printhead element 22, 24, etc. The control circuitry 63 is included in each of the printhead elements to enable the elements to communicate between themselves and with a printer controller (not shown) which specifies the individual printhead elements. The printhead element has an address bus 64 for receiving addresses, a data bus 66 for receiving data and command information, and control inputs 68 for receiving control signals from adjacent printhead elements. In addition, the printhead element has a system clock input 70 for receiving a clocking signal, and an adjusted system clock output 72 for providing an adjusted system clock output signal. A power input 74 and a ground input 76 are connected to printhead element to provide a power and ground path for the printhead element electronic circuitry. A fire strobe input 78 is provided for receiving a fire pulse to synchronize the firing of the transducer elements. The printhead element also includes an address pass-through bus 80 for connecting to the next serial printhead element in the printhead sequence. Similarly, a data command pass-through bus 82 exists in order to communicate data and command information to the next serial printhead element in the printhead sequence.

The printhead element operates under the control of microsequencer 84 having control logic, which, in the preferred embodiment, is implemented using a programmable logic array, as is known in the art. The microsequencer 84 is coupled to a read-only memory 86 (ROM) or other memory means for storing microsequencer instructions. The read-only memory 86 includes an addressing control bus 88 coupled between the microsequencer 84 and the read only memory 86, as well as a data bus 90. The microsequencer 84 is also coupled to a stack memory 94 having a stack pointer for pointing to the current location in the stack. The microsequencer 84 is coupled to the stack 94 through bus 96. The stack 94 operates in a conventional manner as a temporary storage for the most recent data operands of the microsequencer 84. The stack 94 is further coupled to a random access memory (RAM) 98 over bidirectional bus 100. The random access memory 98, in the preferred embodiment, is a static RAM implementation using conventional CMOS technology. The microsequencer 84 and its associated memory components ROM 86, stack 94, and RAM 98, constitute the core control system of the printhead element. In an alternative embodiment, this system could be replaced by a microprocessor-based control system having similar capability.

The microsequencer 84 and associated memory system accomplishes all of the major control functions within the print element. These functions include calculating extended address functions, the printing of patterns, the determination of the locations to be printed and other associated training functions. The purpose of these functions will become more clear in the detailed description of the operation included below.

Address bus 64 is coupled to an address decode and address storage block 102 where the incoming addresses received on address bus 64 are decoded and stored for subsequent use. The addresses specify which printhead element is affected by the current data transmission. The address pass-through bus 80 is coupled to an address output pass-through block 104. Address pass-through block 104 is designed to facilitate the flow of addresses between adjacent printhead elements in the sequence. The address stored in decode and storage block 102 is coupled to the address pass-through block 104 through internal pass-through bus 106. The internal pass-through address bus 106 allows addresses received on address bus 64 to pass through address pass-through block 104 and onto address pass-through bus 80. Connected in this manner, addresses are allowed to propagate along the printhead array under the control of the individual printhead elements.

Control inputs 68 are coupled to control block 108 which includes control registers for the microsequencer 84, control decode and encode logic, and input/output control. Control block 108 is coupled to microsequencer 84 through control bus 110. Control bus 110 transmits control signals from the microsequencer 84 to the control block 108. The control signals convey information about the current instruction that the microsequencer 84 is executing to allow the control block to produce the appropriate response. The control block 108 includes control points 112 that are coupled to a plurality of the logic blocks in order to control and coordinate their activity, e.g., chip select, read or write.

Data bus 66 is coupled to storage registers and decode logic block 67. Command information is sent and received by storage registers and decode logic block 67 over the data bus 66. The command information specifies the desired operation of the heater elements in array 114, such as "fire" or "blank," for the specific pattern of dots desired. In addition, the data bus 66 receives microcode instructions to be executed by microsequencer 84. The data received on the data bus 66 also includes identification and/or personality information for the overall printing environment. The identification information could be the generated by on-line testing and assembly functions during the manufacture of the printhead or based on the actual printer itself. Additionally, drive pulse patterns can also be input to the printhead element over data bus 66, to permit unique operation at relatively high repetition rates for firing the heater array 114 on demand.

The printhead elements each include a heater array 114, which produces the thermal energy required to eject the ink from the inkjet nozzles, and means for driving the heater array. The means for driving the heater array can include skew adjust storage drive block 92 which adjusts the drive pulse provided to the heater array 114 in order to compensate for system level variations, as described further below. As indicated above, the skew adjust block 92 is coupled to the read-only memory 86 through ROM data bus 90. The skew adjust block receives information from the read-only memory over ROM data bus 90 to indicate the appropriate adjustment required for the current system operating conditions. Skew adjust block 92 is further coupled to random access memory 98 through bidirectional bus 100. The skew adjust block 92 is coupled to driver pulse generator 116 which also includes a multiplexer to final drive circuit 118. The multiplexer selects the appropriate heater element of the heater array 114 for a given set of inputs. The skew adjust block 92, with associated RAM 98, increases print quality and reduces manufacturing requirements by modifying the printing pattern due to variations in the manufacture of the unit.

The driver pulse generator 116 is coupled to the skew adjust block 92 through drive bus 120 and coupled to final drive circuit 118 through final drive bus 122. The drive pulse generator 116 is further coupled to drive pulse shaped storage register 124 through bus 126. The drive pulse shape storage register 124 stores information on the current pulse width of the drive pulse produced by drive pulse generator 116. The drive pulse generator 116 produces a drive pulse signal over final drive bus 122 that is coupled to the final drive circuit 118. The final drive circuit 118 further refines the drive pulse signal to produce a final drive signal on heater bus 128 that is coupled between the final drive circuit 118 and heater array 114. In addition, the driver pulse generator 116 is coupled to power control logic block 130 which receives a system clock signal over system clock input 70 and produces an adjusted system clock signal on adjusted system clock output 72. The power control logic block 130 produces a synchronization signal that is coupled to the pulse drive generator 116 over synchronization line 132.

In the preferred embodiment, a paper velocity and positive analysis circuit 134 is included to receive paper velocity and position information from an external paper velocity and position transducer 136 over transducer lines 137, coupled between paper velocity analysis circuit 134 and the external paper velocity position transducer 136. The paper analysis circuit 134 permits a more accurate understanding of the precise location of the print media and hence improve the print quality once again.

The printhead element may also include a thermal sense circuit including thermal sense analysis circuit 139, thermal sense element 141 and a multiplexer 143. One major issue in thermal inkjet printing is the fact that as the duty cycle of a print-head increases, there can be a considerable increase in the temperature of which can lead to a reduction in print quality. The thermal circuit allows the printhead element to compensate for increases in thermal temperature. The thermal sense element 141 detects the temperature. The thermal sense circuitry 139 can then adjust the rate of data transfer, and/or printing, by modulating the output clock 72, to control the temperature of the heater elements and thereby reduce both the overall peak power demand of the printing unit as well as increase the print quality.

The power control logic block 130 aids in this control of the peak power by adjusting the system and internal clocks to reduce the overall power consumption. In addition, to maintain the power consumption within an appropriate range, the printhead array can reroute printer commands back to the printer processor (not shown) to reduce printing speed if the temperature of the array or a location in the array was exceeding any design specification.

Figure 4:
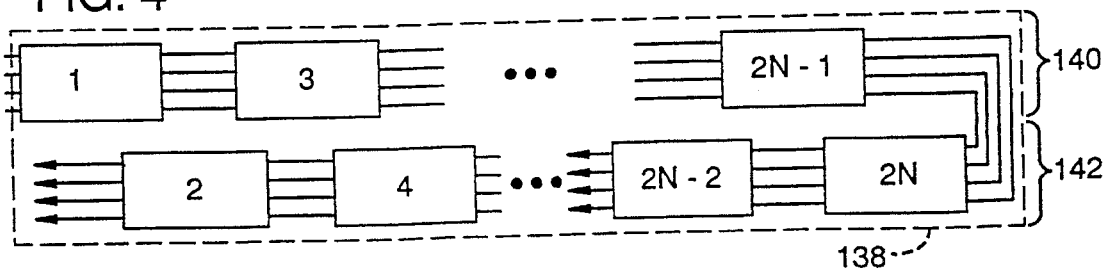
FIG. 4 is a first method of interconnecting the printhead elements of one of the arrays of FIG. 1.
Figure 5:
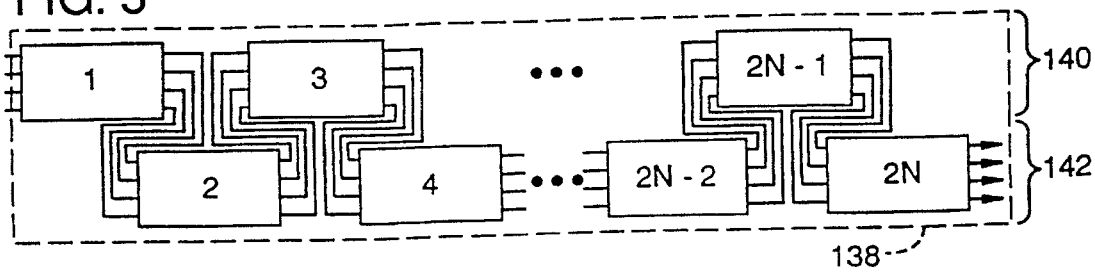
FIG. 5 is a second method of interconnecting the printhead elements of one of the arrays of FIG. 1.

Referring now to FIGS. 4–5, a plurality of individual printhead elements 1–2N are mounted on a flexible interconnect circuit 138 to form a printhead array, such as those shown in FIG. 1. The flexible interconnect circuit is formed on a flexible insulative material having integral conductors. Alternatively, the interconnect could be formed using conventional rigid circuit board material. The individual elements are arranged in a first row of elements 140 and a second row of elements 142. The flexible interconnect circuit 138 provides for the electrical interconnect between all of the individual printhead elements. There are two distinct methods of interconnect as described by the invention. The first interconnect method, shown in FIG. 4, is to serially connect each of the individual elements in the first row 140 from left to right, i.e., 1, 3, . . . 2N–1, and then to each of the elements in the second row 142 from right to left, i.e., 2N, 2N–2, . . . 2. In this way, very little additional area is consumed by the individual conductors connecting between the individual printhead elements.

A second interconnect method is shown in FIG. 5. In this method, the individual printhead elements are alternately serially connected between the first and second rows 140, 142. In this way the conductors connect the elements from left to right in the order shown, i.e., 1, 2, 3, . . . 2N. The benefit of this interconnect method is that the elements are connected in the same order as the nozzles on the printhead. The details of the interconnect methods and the corresponding electrical interconnect are described below.

Figure 6:
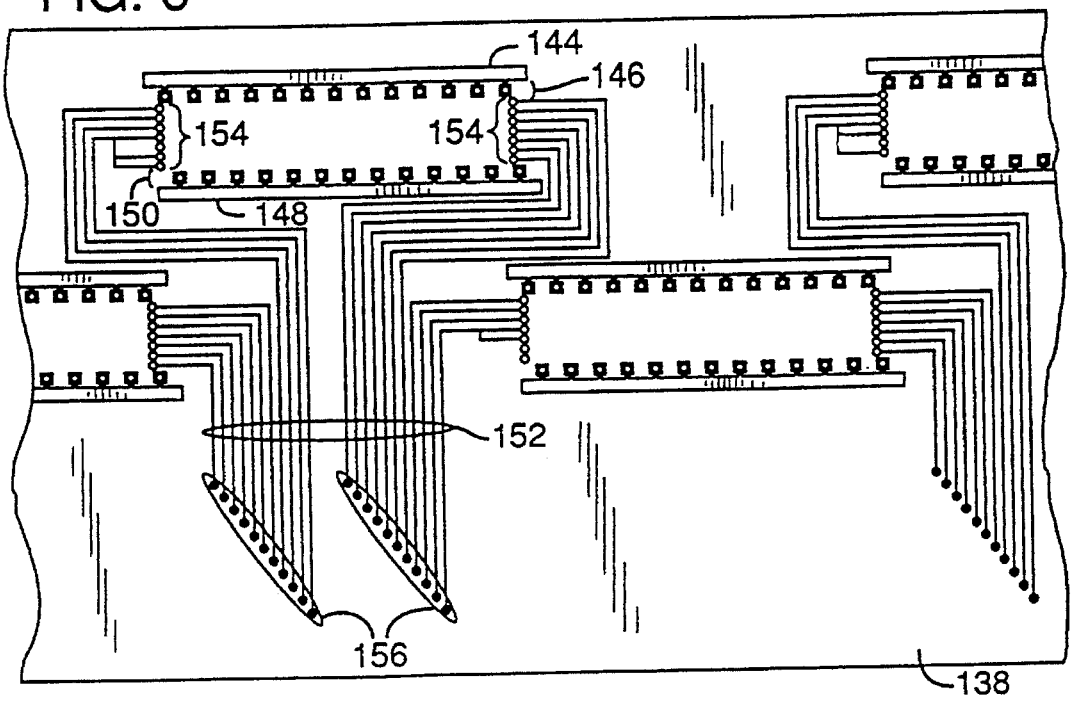
FIG. 6 is a plan view of a portion of a flexible interconnect for multilevel interconnection of the printhead elements on the printhead.

Referring now to FIG. 6, the back side of the flexible interconnect 138 is shown. A first ink manifold 144 is shown connected to a first row of nozzles by short conduits for supplying ink from the ink manifold 144 to the first row of nozzles 146. Similarly, a second ink manifold 148 is shown coupled to a second row of nozzles by conduit for supplying ink deposited in the second ink manifold 148 to the second row of nozzles 150. The printhead elements are mounted on the opposite side the flexible circuit 138 (see FIGS. 4 and 5) in the area defined by the two rows of nozzles 146 and 148. Each nozzle of the first and second rows are coupled to an output driver of the individual printhead element.

A plurality of conductors 152 is shown coupled to contact pads 154. The printhead driver (not shown) is mounted on the flexible interconnect 138 so that the leads of the printhead driver are in electrical contact with contact pads 154. In this way, address and data information can be transmitted to the individual printhead driver via conductors 152. Conductors 152 are electrically connected to a second level of metallization on a front side of the flexible interconnect 138 through vias 156. Thus, all of the elements on the printhead array receive the same information substantially simultaneously. This implementation is known herein as a parallel bus implementation.

Figure 7:
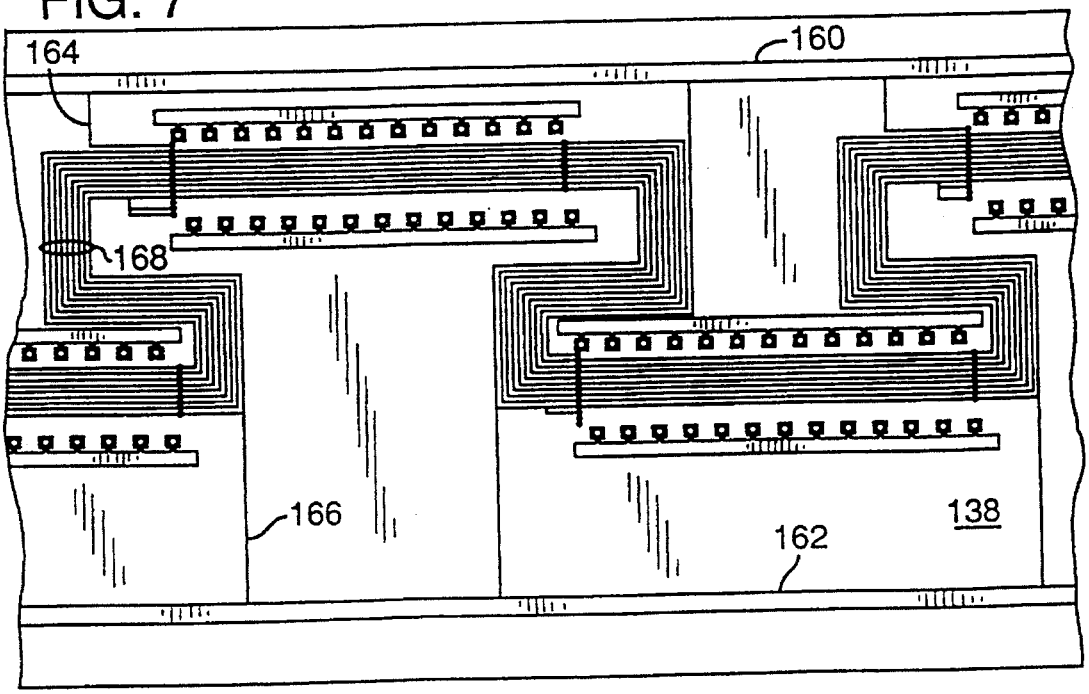
FIG. 7 is a plan view of a portion of a flexible interconnect for interconnecting the printhead elements on the printhead which requires only a single level of metallization.

Alternatively, a parallel bus implementation can be implemented on the flexible interconnect with only a single level of metallization as shown in FIG. 7. In the parallel bus implementation shown in FIG. 7, conductors 168 are connected substantially similarly to each of the individual printhead elements on the array. The conductors 168 are routed across the face of each printhead element thereby eliminating the vias that were required in FIG. 6 to connect the second level of metallization. The conductors can be routed on the flexible interconnect 138 as shown or alternatively routed through the printhead element (not shown) by placing the traces on the silicon die of the printhead element. Two separate buses which are required to carry significant currents, the power supply bus 160 and ground bus 162, are routed as separate traces parallel to the row of printhead elements. The individual connections to the power supply bus 160 and the ground bus 162 are provided by separate conductors 164 and 166, respectively. This provides a low impedance path for the current supply to the transducer elements on the printhead elements.

Figure 8:
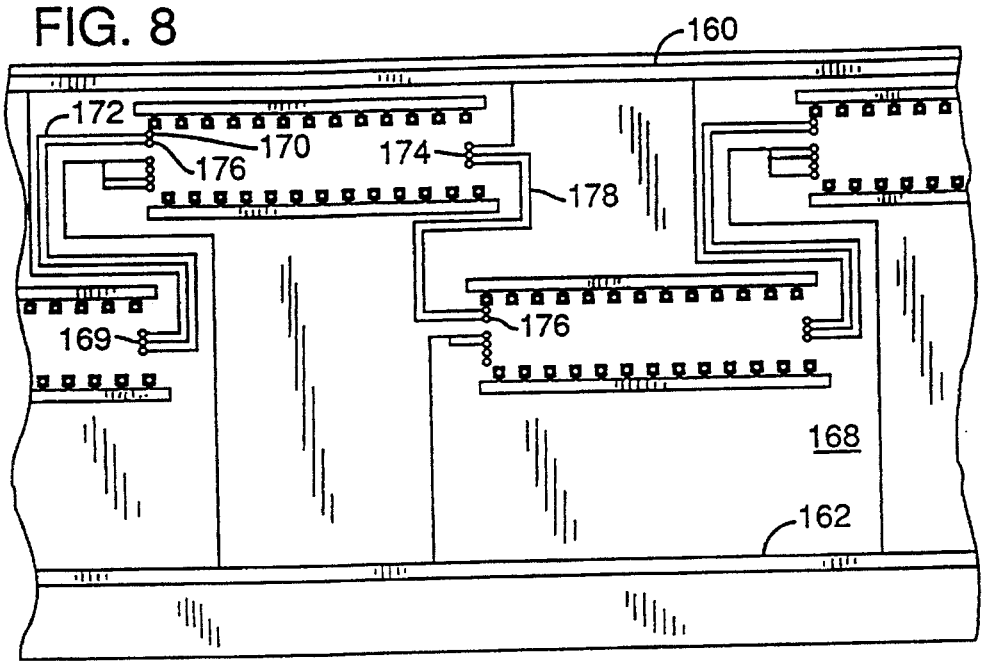
FIG. 8 is a plan view of a portion of a flexible interconnect for interconnecting the printhead elements on the printhead which uses a serial data bus.

In FIG. 8, a serial bus implementation is shown on a flexible interconnect 168 having a single level of metallization. The serial implementation is a further simplification of the parallel implementation by requiring only a single conductor to transfer information between electrically adjacent elements on the printhead. A serial output contact pad 169 is connected to a serial input contact pad 170 of the electrically adjacent element through first conductor 172. Similarly, a second serial output contact pad 174 is connected to a second serial input contact pad 176 through second conductor 178. By serially connecting the elements in this manner, only a single conductor is required between electrically adjacent elements to communicate address and data information between the two.

Figure 9:
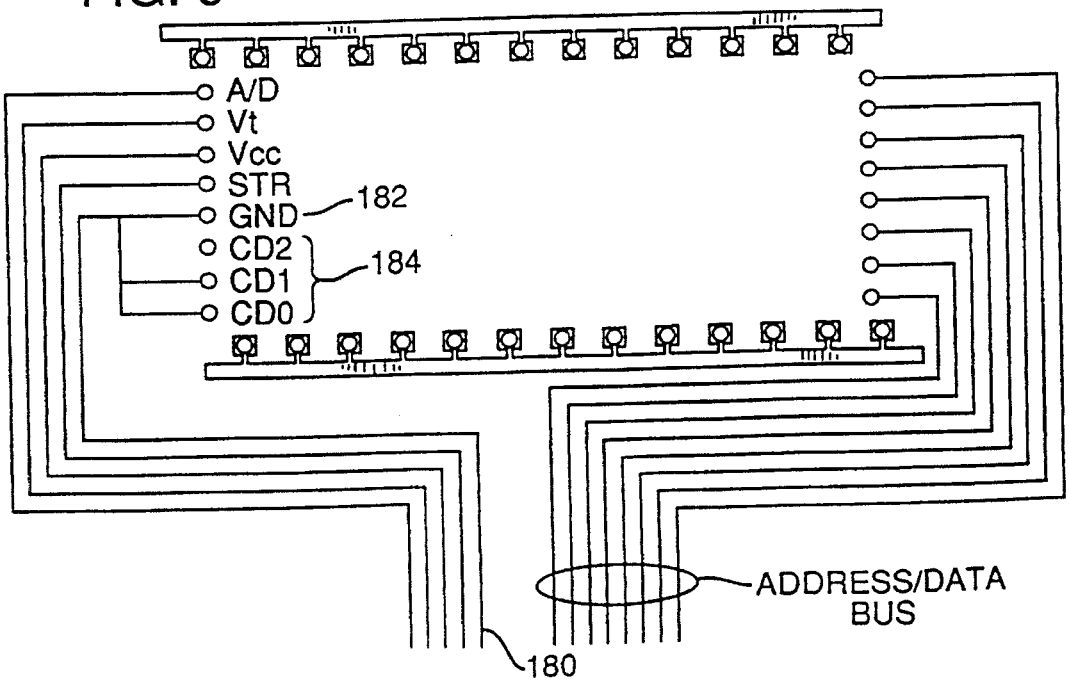
FIG. 9 is an enlarged plan view of a portion of a flexible interconnect for a single printhead element showing the chip select lines selectively connected to ground.

Both the parallel and serial implementations require a means for assigning a unique address to each of the elements along the printhead array. In this way, data that is sent out along the bus, whether it be serial or-parallel, is received by the appropriate printhead element. In FIG. 9 a first means for assigning a unique address to the printhead element is shown. A conductor 180 that is connected to the ground bus 162 (FIG. 8) is connected to a ground contact pad 182 as well as one or more chip define pads 184. The precise manner in which conductor 180 is connected to the chip define pads 184 determines the unique address that is assigned to the particular element.

The corresponding printhead driver (not shown) has pullup resistors at the input pads on the printhead elements corresponding to the locations of the chip define pads 184. Thus, if a chip define pad is not connected to ground, the corresponding chip define input, as seen by the printhead element, will be at a logic "1". Alternatively, if the chip define pad is connected to ground, the corresponding chip define input will be at a logic "0". In this manner, the chip define inputs comprise a binary address corresponding to the particular printhead element. In an equivalent embodiment, the chip define pads could be selectively connected to the positive supply voltage $V_{cc}$ and the printhead element have pulled down resistors. The number of chip define pads that are required is a function of the number of printhead elements that comprise the printhead array. The number of chip define pads needed can be determined by the following equation: Number of Pads=$LOG_2(N)$, where N equals the number of elements in printhead array.

In the preferred embodiment, the chip define pads are connected to grounds so that successive elements on the printhead array have increasingly greater addresses. Once the unique address has been established, the individual printhead elements can compare the address received over the address bus to that programmed on the chip define pads. In the event that the address received on the address bus matches that received on the chip define pads, the printhead elements receives the accompanying data received on the data bus as a command directed to that particular element.

Alternatively, the printhead elements can "learn" their address through a initialization sequence, as described in detail below. In the initialization sequence, the first printhead element receives a first "strobe" from the printer logic to indicate the beginning of the initialization sequence. Since it is the first printhead element in the sequence, it assigns to itself the first address and passes that address on to the next element in the sequence. The next element in the sequence receives this address over the data bus and assigns itself the next address in the sequence and passes this address on to the next element in the sequence. This process continues until all of the elements have been assigned an address. This can be accomplished by having a power up default address that is used for all of the printhead elements before they are assigned an address.

OPERATION

As described in the background of the invention, one of the primary problems with designing high-resolution, page-width printheads is the amount of data required to selectively enable the individual heater elements. The present invention minimizes the amount of data necessary to specify the individual heater elements by sending high level print commands to the individual printhead elements. The commands can specify a range of nozzles to be printed, e.g., a vector, or even an entire geometrical object such as a circle. The printhead element control circuitry then interprets the command and actuates the appropriate heater elements. The number of available commands determines the size of the required data bus over which the commands are passed. For example, an 8-bit data bus will support up to 256 unique commands, i.e., $2^8$=256.

In order to calculate the number of address bits required by the address bus, the total number of heater elements is required. For a 4-color, 600 dpi printhead spanning a 12 inch (30.5 cm) wide page, there are approximately 28,800 individual heater elements. Thus, an address bus having 16-bits is more than adequate to individually address each heater element, i.e., $2^{16}$=65,536. In preferred practice, each printhead element is designed to have 4 extra nozzles at each end for overlap to its two nearest neighbors, as shown in FIG. 2. Therefore, assuming each printhead element normally drives 300 heater elements, the actual number of nozzles which need independent addresses is therefore (300+8 nozzles per head)*(24 heads/array)*4(arrays/printer)=29,568, which is still well within the capacity of a 16-bit address. In order to reduce the number of address lines, however, two 8-bit address portions, i.e., upper and lower bytes, can be transmitted in succession using only an 8-bit address bus.

As mentioned before, there are about 28,800 independent locations on any 1/600" column on a 12 inch (30.5 cm) page. This means that the page-wide array and associated printer will need to go through some kind of learning process to determine how to overlap the array elements. This process need be done only when the array is physically disturbed from its equilibrium position, such as one of the printhead elements are replaced. When the array is first manufactured, or whenever any element is replaced, the print-array shall (with an operator or computer's intervention) perform test prints to determine the selection of the overlapping nozzles as well as the firing order.

Alternatively, the overlapping nozzles can be randomly overlapped in an attempt to diffuse any errors of alignment. The result in the array is that when these "edge-overlap" nozzles are in use, it is likely that the dots will emit from one of 4 nozzles in a gaussian distribution with some pseudo-random sequencing. The result to the eyes of the observer is that it will not be possible to observe the point where one head in the array is printing over and above where the next head is printing. The process of assigning overlapping nozzles can be fully automatic or completely manual, depending upon cost of installation and price of printer.

Once the overlapping nozzles have been assigned, as described above, each printhead element will determine, i.e., learn, which nozzle addresses are associated with the element. This address information is stored in the non-volatile memory within the printer and used whenever a command is issued over the data bus.

The printhead elements teach/learn their proximity to/from adjacent elements. A first element in the array receives a first "strobe" from the printer logic and then passes information on to the remaining elements. Since it is the first chip, it represents the first ½ inch (1.27 cm) of print zone, and recognizes that it is both responsible for the page-edge border as well as the next chip overlap. This, in the case of the black printing array, represents the first 300 dot locations on the page.

At this point, it is necessary to realize that the printer will be sending information regarding absolute dot location, while the print array will be "relatively" positioned. The conversion from absolute dot location to relative dot address will be performed by each printhead on the data stream. In other words, the data arrives at the first printhead in the array. That printhead then decodes the data for its relative locations (assuming it has already trained itself and the other elements of the array as to their overlap locations) and then will change the addresses for the remainder of the array prior to forwarding the data to them. It will merely not send data which is solely destined for it. The remainder of the array will behave similarly, i.e., the other elements will modify data as it enters to forward the remaining data elements to their proper destinations. Whenever a new element arrives in the array, only the elements directly upstream and downstream from it will therefore need to re-train themselves to establish the boundaries of the data to receive, since that chip will have a new algorithm for data transfer.

The complexity of the commands sent to the printhead elements determines the complexity required in the control engine of the printhead elements. The more complex the command set, the more "intelligent" the elements must be in order to decode the commands. The more complex the command set, however, the lower the bandwidth required to transmit the commands to the elements.

For example, in a simple embodiment, each nozzle address can be individually addressed. Although a simple printhead element control engine can be used to decode these commands, this places a tremendous bandwidth requirement on both the address and data bus, e.g., 91 MHz data transfer rates. In a more sophisticated embodiment, each printhead element assumes that if a particular nozzle address is not received, no dot is to be printed. For text printing, the usual coverage is on the order of 5 to 10% of the full surface of the paper, and, in addition, text is primarily of one color only. This results in a significant decrease in the bandwidth required, e.g., 7.5 MHz data transfer rates, which is slower than most personal computer bus speeds.

In a yet more intelligent embodiment, logical instructions are used, such as those mentioned above, to specify the operation for a plurality of nozzles in a single command. In this more intelligent array, 8-bit data permits up to 256 separate commands. For the sake of rapid filling of a memory array within the printhead array, however, filling bit-by-bit when a command is to make a line or a colored region is unnecessary. Instead, a command such as "print 1's on every dot location from current address to next address sent" would easily reduce the data transfer rate in graphics mode. The entire series of PCL™ languages by Hewlett Packard of Palo Alto, Calif., are in essence, reductions to practice of this form of data compression.

Having described and illustrated the principles of the invention in a preferred embodiment thereof, it should be apparent that the invention can be modified in arrangement and detail without departing from such principles. I claim all modifications and variation coming within the spirit and scope of the following claims.

We claim:

1. A page wide ink jet printhead containing a reservoir of ink comprising:

a page-wide printhead substrate having a first dimension defining a printhead width, the printhead having a plurality of groups of orifices formed therein to incrementally encompass the width of the printhead;

a plurality of groups of heater elements mounted on the substrate, each heater element for vaporizing ink disposed proximate a corresponding orifice to eject the ink therefrom;

a plurality of printhead circuit elements mounted on the substrate, each circuit element associated with a group of heater elements for selectively energizing a heater element from the group; and means for serially interconnecting the printhead circuit elements, said interconnecting means providing an address and an associated command to a printhead circuit element, the address specifying a printhead circuit element that the command is addressed to, and the command specifying which of the heater elements in the addressed printhead circuit element are to be actuated.

2. A page wide ink jet printhead according to claim 1 wherein the plurality of printhead circuit elements comprises:

a first row of printhead elements mounted on the substrate, each element in the first row having a right and a left side and a row of nozzles parallel to the first row of elements for ejecting ink; and a second row of printhead elements mounted on the substrate, each element in the second row having a right and a left side and a row of nozzles parallel to the second row of elements for ejecting ink;

the second row of printhead elements mounted parallel to and offset from the first row such that a leftmost distal nozzle of a second row element is opposed to a rightmost distal nozzle of a first row element, and a rightmost distal nozzle of a second row element is opposed to a leftmost distal nozzle of a first row element.

3. A page wide ink jet printhead according to claim 2 wherein the second row of printhead elements is mounted parallel to and offset from the first row such that two leftmost distal nozzles of a second row element are opposed to two rightmost distal nozzles of a first row element, and two rightmost distal nozzles of a second row element are opposed to two leftmost distal nozzles of a first row element.

4. A page wide ink jet printhead according to claim 2 wherein the elements of the first and second row have a bottom row of nozzles parallel to the top row of nozzles such that each of the bottom row nozzles is equidistant from two top row nozzles.

5. A page wide ink jet printhead according to claim 1 wherein the means for serially interconnecting the printhead circuit elements comprises a plurality of conductors extending widthwise of the printhead including an address bus and a data bus coupled to each printhead element.

6. A page wide ink jet printhead according to claim 5 wherein the plurality of printhead circuit elements comprises:

a first row of printhead elements mounted on the substrate, each element in the first row having a right and a left side and a row of nozzles parallel to the first row of elements for ejecting ink;

a second row of printhead elements mounted on the substrate, each element in the second row having a right and a left side and a row of nozzles parallel to the second row of elements for ejecting ink; and address and data busses connects serially between a first row element and then to each of the second row elements.

7. A page wide ink jet printhead according to claim 5 wherein the plurality of printhead circuit elements comprises:

a first row of printhead elements mounted on the substrate, each element in the first row having a right and a left side and a row of nozzles parallel to the first row of elements for ejecting ink;

a second row of printhead elements mounted on the substrate, each element in the second row having a right and a left side and a row of nozzles parallel to the second row of elements for ejecting ink; and address and data busses connects serially between the first row elements and the second row elements alternating between the first and second rows of elements.

8. A page wide ink jet printhead according to claim 1 including electric circuit addressing means coupled to each of the circuit elements for assigning a unique circuit element address to each element.

9. A page wide ink jet printhead according to claim 8 wherein the addressing means comprises a plurality of chip define lines coupled to each circuit element, each chip define line coupled to one of a first supply voltage representing a first binary state and a second supply voltage representing a second binary state, the chip define lines encoding a binary address corresponding to the circuit element coupled thereto.

10. A page wide ink jet printhead containing a reservoir of ink comprising:

a page-wide printhead substrate having a first dimension defining a printhead width, the printhead having a plurality of groups of orifices formed therein to incrementally encompass the width of the printhead;

a plurality of groups of heater elements mounted on the substrate each heater element for vaporizing ink disposed proximate a corresponding orifice to eject the ink therefrom;

a plurality of printhead circuit elements mounted on the substrate, each circuit element associated with a group of heater elements for selectively energizing a heater element from the group;

means coupled to each of the circuit elements for assigning a unique circuit element address to each element, wherein the addressing means comprises a memory within each of the circuit elements for storing an assigned address uniquely corresponding to the position of the element in the array; and means for serially interconnecting the printhead circuit elements.

11. A page wide ink jet printhead element for ejecting ink through ink-jet nozzles mounted on the array, comprising:

a heater array including a plurality of heater elements, each element in communication with an individual ink-jet nozzle;

means coupled to the heater array for actuating the heater array, the actuating means having a clock input for receiving a clock input signal and a fire strobe input for receiving a fire strobe pulse to synchronize the generation of an actuation pulse, which energizes a heater element such that ink is ejected from a corresponding nozzle;

an address pass-through network including an address bus for sending and receiving addresses to and from a previous printhead element in the array and an address pass-through bus for selectively sending addresses to a subsequent printhead element in the array;

a data pass-through network including a data bus for sending and receiving data to and from a previous printhead element and a data/command pass-through bus for selectively sending data to a subsequent printhead element; and means for controlling the printhead element coupled to the address pass-through network, the data pass-through network, and the actuating means, the control means having control input lines for receiving control signals.

12. A printhead element according to claim 11 in which the controlling means comprises:

a sequencer for executing micro-instructions;

a nonvolatile memory coupled to the sequencer for storing and retrieving the micro-instructions; and a read-write memory coupled to the sequencer for providing temporary storage for the sequencer.

13. A printhead element according to claim 12 in which the read-write memory comprises:

a random access memory for temporary storage;

a stack coupled to the random access memory for storing current operands used by the sequencer;

a stack pointer coupled to the stack for pointing to the current level of the stack;

control registers for storing command information coupled to the sequencer control means; and control logic coupled to the control lines for controlling the address and data busses.

14. A printhead element for ejecting ink through ink jet nozzles comprising;

a heater array including a plurality of heater elements, each element in communication with an individual ink jet nozzle;

means coupled to the heater array for actuating the heater array, the actuating means having a clock input for receiving a clock input signal and a fire strobe input for receiving a fire strobe pulse to synchronize the generation of an actuation pulse, which energizes a heater element such that ink is ejected from a corresponding nozzle;

an address pass-through network including an address bus for sending and receiving addresses to and from a previous printhead element in the array and an address pass-through bus for selectively sending addresses to a subsequent printhead element in the array, wherein the address pass-through network includes an address decoder for identifying an address corresponding to the printhead element and address storage registers for storing addresses received on the address bus;

a data pass-through network including a data bus for sending and receiving data to and from a previous printhead element and a data/command pass-through bus for selectively sending data to a subsequent printhead element; and means for controlling the printhead element coupled to the address pass-through network, the data pass-through network, and the actuating means, the control means having control input lines for receiving control signals.

15. A printhead element for ejecting ink through ink jet nozzles comprising:

a heater array including a plurality of heater elements, each element in communication with an individual ink jet nozzle;

means coupled to the heater array for actuating the heater array, the actuating means having a clock input for receiving a clock input signal and a fire strobe input for receiving a fire strobe pulse to synchronize the generation of an actuation pulse, which energizes a heater element such that ink is ejected from a corresponding nozzle;

an address pass-through network including an address bus for sending and receiving addresses to and from a previous printhead element in the array and an address pass-through bus for selectively sending addresses to a subsequent printhead element in the array;

a data pass-through network including a data bus for sending and receiving data to and from a previous printhead element and a data/command pass-through bus for selectively sending data to a subsequent printhead element, wherein the data pass-through network includes a command decoder for decoding command data received on the data bus and data storage registers for storing data received on the data bus; and means for controlling the printhead element coupled to the address pass-through network, the data pass-through network and the actuating means the control means having control input lines for receiving control signals.

16. A printhead element for ejecting ink through ink jet nozzles mounted on the array, comprising:

a heater array including a plurality of heater elements each element in communication with an individual ink jet nozzle;

means coupled to the heater array for actuating the heater array, the actuating means having a clock input for receiving a clock input signal and a fire strobe input for receiving a fire strobe pulse to synchronize the generation of an actuation pulse, which energizes a heater element such that ink is ejected from a corresponding nozzle, wherein the actuating means includes skew adjust and storage drive means coupled to the control means for controlling the skew of the actuation pulse, a drive pulse generator coupled to the skew adjust and storage drive means for determining a pulse width of the actuation pulse, and a power control logic block coupled to the drive pulse generator for supplying current needed to energize the heater elements;

an address pass-through network including an address bus for sending and receiving addresses to and from a previous printhead element in the way and an address pass-through bus for selectively sending addresses to a subsequent printhead element in the array;

a data pass-through network including a data bus for sending and receiving data to and from a previous printhead element and a data/command pass-through bus for selectively sending data to a subsequent printhead element; and means for controlling the printhead element coupled to the address pass-through network, the data pass-through network, and the actuating means, the control means having control input lines for receiving control signals.

17. A printhead element for ejecting ink through ink jet nozzles mounted on the array, comprising:

a heater array including a plurality of heater elements, each element in communication with an individual ink jet nozzle;

means coupled to the heater array for actuating the heater array, the actuating means having a clock input for receiving a clock input signal and a fire strobe input for receiving a fire strobe pulse to synchronize the generation of an actuation pulse, which energizes a heater element such that ink is ejected from a corresponding nozzle, wherein the actuating means includes skew adjust and storage drive means coupled to the control means for controlling the skew of the actuation pulse, a drive pulse generator coupled to the skew adjust and storage drive means for determining a pulse width of the actuation pulse, and a power control logic block coupled to the drive pulse generator for supplying current needed to energize the heater elements;

an address pass-through network including an address bus for sending and receiving addresses to and from a previous printhead element in the array and an address pass-through bus for selectively sending addresses to a subsequent printhead element in the array;

a data pass-through network including a data bus for sending and receiving data to and from a previous printhead element and a data/command pass-through bus for selectively sending data to a subsequent printhead element; and means for controlling the printhead element coupled to the address pass-through network, the data pass-through network, and the actuating means, the control means having control input lines for receiving control signals, wherein the control means includes a drive pulse shape register coupled to the drive pulse generator for storing drive pulse shape data.

18. A printhead element according to claim 11 further including thermal sense analysis circuits coupled to the control means.

19. A printhead element according to claim 18 further including thermal sense elements coupled to the thermal sense analysis circuits for detecting the ambient temperature of the printhead element.

20. A printhead element for ejecting ink through ink jet nozzles mounted on the array, comprising:

a heater array including a plurality of heater elements, each element in communication with an individual ink jet nozzle;

means coupled to the heater array for actuating the heater array, the actuating means having a clock input for receiving a clock input signal and a fire strobe input for receiving a fire strobe pulse to synchronize the generation of an actuation pulse, which energizes a heater element such that ink is ejected from a corresponding nozzle;

an address pass-through network including an address bus for sending and receiving addresses to and from a previous printhead element in the array and an address pass-through bus for selectively sending addresses to a subsequent printhead element in the array;

a data pass-through network including a data bus for sending and receiving data to and from a previous printhead element and a data/command pass-through bus for selectively sending data to a subsequent printhead element;

means for controlling the printhead element coupled to the address pass-through network, the data pass-through network and the actuating means the control means having control input lines for receiving control signals; and print media velocity analysis circuits coupled to the control means.

21. A printhead element according to claim 20 further including print media velocity elements coupled to the velocity analysis circuits for detecting the velocity of print media relative to the printhead element.

22. A method of printing using a page wide ink jet printer where the printer includes a printhead having a row of nozzles capable of depositing an ink droplet on a plurality of pixels of a print medium and a printer controller for specifying the particular nozzles to be actuated to form a desired image on the print media, the method comprising the steps of:

providing a first number of printer elements, each element including a second number of heater elements;

arranging the printer elements on the printhead so that each heater element is coupled to a corresponding printhead nozzle;

assigning a unique address to each printer element;

issuing a print command to a printer element address specifying which of the printer elements the print command is addressed to, the print command indicating the nozzle within the addressed printer element to be actuated;

selecting the nozzles indicated in the print command; and ejecting ink droplets from the selected nozzles.

23. A method of printing using a page wide ink jet printer where the printer includes a printhead having a row of nozzles capable of depositing an ink droplet on a plurality of pixels of a print medium and a printer controller for specifying the particular nozzles to be actuated to form a desired image on the print media, the method comprising the steps of:

providing a first number of printer elements, each element including a second number of heater elements;

arranging the printer elements on the printhead so that each heater element is coupled to a corresponding printhead nozzle, wherein the arranging step includes overlapping nozzles coupled to a printer element with nozzles coupled to two adjacent printer elements;

assigning a unique address to each pixel location in a row;

initializing each printer element so that each nozzle is assigned a corresponding address location;

issuing a print command to the printer elements, the print command indicating the nozzle addresses to be actuated;

selecting the nozzles indicated in the print command; and ejecting ink droplets from the selected nozzles.

24. A method of printing according to claim 23 wherein the initializing step comprises:

printing a known image on the print media;

reassigning the addresses corresponding to the pixel locations having overlapping nozzles to one of the two printer elements between which the nozzles overlap.

25. A method of printing according to claim 22 wherein the step of issuing a print command comprises transmitting the print command to the print elements simultaneously.

26. A method of printing according to claim 25 wherein the step of transmitting the print command to the print elements simultaneously includes:

interconnecting the printer elements by a parallel bus; and transmitting the print command over the parallel bus to the printer elements.

27. A method of printing according to claim 22 wherein the step of issuing a print command comprises transmitting the print command to the print elements serially.

28. A method of printing according to claim 27 wherein the step of transmitting the print command to the print elements serially includes:

interconnecting the printer elements by a serial bus; and transmitting the print command over the serial bus to the printer elements.

29. A method of printing according to claim 28 wherein the step of transmitting the print command over the serial bus to the printer elements includes:

transmitting the print command to a first printer element; and forwarding the print command to a second printer element.

30. A method of printing according to claim 29 wherein the step of forwarding the print command to a second printer element includes:

decoding the print command by the first printer element; and transmitting the print command to the second printer element only if the print command is not addressed to the first printer element.

31. A method of printing according to claim 22 wherein the step of assigning a unique address to each printer element includes encoding a unique identifier for each printer element on an interconnect circuit connecting the printer elements.

32. A method of printing according to claim 22 wherein the step of assigning a unique address to each printer element includes:

assigning a first address to a first printer element;

transmitting the first address to the first printer element;

incrementing the first address to form a second address; and transmitting the second address to a second printer element, wherein the second printer element is adjacent to the first printer element.

33. A method of printing according to claim 22 wherein the step of assigning a unique address to each printer element includes:

transmitting a first address to a first printer element;

incrementing the first address to form a second address; and transmitting the second address to a second printer element, wherein the second printer element is adjacent to the first printer element.

* * * * *